US008073183B2

(12) United States Patent
Liao

(10) Patent No.: US 8,073,183 B2
(45) Date of Patent: Dec. 6, 2011

(54) AUDIO PLAYING DEVICE

(75) Inventor: Jui Tsung Liao, Taipei (TW)

(73) Assignee: Kye Systems Corp., Taipei (TW)

( * ) Notice: Subject to any disclaimer, the term of this patent is extended or adjusted under 35 U.S.C. 154(b) by 484 days.

(21) Appl. No.: 12/379,215

(22) Filed: Feb. 17, 2009

(65) Prior Publication Data

US 2009/0214074 A1 Aug. 27, 2009

(30) Foreign Application Priority Data

Feb. 22, 2008 (TW) ..... 97106370 A

(51) Int. Cl.
*H04R 1/02* (2006.01)

(52) U.S. Cl. ..... 381/386

(58) Field of Classification Search ..... 381/386, 381/191, 190, 116, 399, 176, 152, 174
See application file for complete search history.

(56) References Cited

FOREIGN PATENT DOCUMENTS

WO WO 0219764 A1 3/2002

*Primary Examiner* — Jarrett Stark
*Assistant Examiner* — Lawrence Tynes, Jr.
(74) *Attorney, Agent, or Firm* — Bacon & Thomas, PLLC

(57) ABSTRACT

An audio playing device includes an audio player and a soft speaker. The soft speaker has features such as light weight and flexibility, and a combination of the soft speaker and the audio player is convenient for carrying and accommodation, such that diversified structures, for example, fan, umbrella, or flag etc. are designed by reason of the flexibility.

11 Claims, 8 Drawing Sheets

AUDIO PLAYING DEVICE

CROSS-REFERENCE TO RELATED APPLICATIONS

This non-provisional application claims priority under 35 U.S.C. §119(a) on Patent Application No(s). 097106370 filed in Taiwan, R.O.C. on Feb. 22, 2008 the entire contents of which are hereby incorporated by reference.

BACKGROUND OF THE INVENTION

1. Field of Invention

The present invention relates to an audio playing device, and more particularly to an audio playing device applying a soft speaker.

2. Related Art

Recently, a common audio playing device, for example, an MP3 player, usually uses an earphone or a hard speaker to play music. However, the earphone cannot wholly show the music effect, and is harmful to human ears after long time of use. The hard speaker has problems of relatively heavier weight and fixed appearance. For the audio playing device, it is inconvenient for the user to carry due to the heavier weight, and in convenient in accommodation due to the fixed appearance. Moreover, the appearance is undiversified.

Recently, in this field, a flexible soft speaker is developed by combining the flexible electronic technique with an electrostatic speaker. For example, in Word Patent No. WO0219764, a flexible soft speaker is disclosed. Different from the principle of the conventional speaker, the flexible soft speaker applies an electrostatic force to cause a conductive diaphragm generate various resonance frequencies, such that the flexible soft speaker efficiently serves as a loudspeaker, has the features of light weight and flexibility, and has a great market competitiveness.

However, recently the soft speaker is still in the experimental stage, and is not further applied to products. Therefore, if the soft speaker is efficiently applied to the audio playing device, the audio playing device may have reduced weight and be convenient in carrying, so as to solve the problem of the recent common audio playing device.

SUMMARY OF THE INVENTION

In order to solve the problems of the prior art, the present invention is directed to an audio playing device, so as to solve the problems in the prior art such as inconvenient carrying and accommodation, and undiversified appearance.

In an embodiment of the present invention, an audio playing device includes an audio player, at least one soft speaker, and at least two suspension edges.

The audio player includes a micro processor, a signal processor, an amplifier, a memory, and a power supplier. The soft speaker includes a diaphragm. The diaphragm has a first electrode and a second electrode. The two suspension edges are respectively a first suspension edge and a second suspension edge, the first suspension edge is electrically connected to the first electrode of the diaphragm, and the second suspension edge is electrically connected to the second electrode of the diaphragm.

The micro processor controls an operation of the audio player. The memory stores at least one audio data, and is electrically connected to the micro processor. The signal processor codes and decodes the audio data, and is electrically connected to the micro processor. The amplifier amplifies gains of the audio data and outputs the amplified audio data, and is electrically connected to the signal processor. The power supplier supplies an electrical power, and is electrically connected to the micro processor and the memory. A control key inputs manipulation instructions, and is electrically connected to the micro processor.

The amplifier has a positive electrode and a negative electrode, the positive electrode of the amplifier is electrically connected to the first suspension edge, and the negative electrode of the amplifier is electrically connected to the second suspension edge, for transmitting the audio data to the soft speaker for playing.

To sum up, through the technical means of the present invention, because of the features of the soft speaker such as the light weight and the flexibility, the problems of the hard speaker of the common audio playing device, for example, the weight is relatively heavier, and the fixed appearance is inconvenient for accommodation, are thus solved. In addition, the audio playing device having the soft speaker may be designed to appearances being different from that of the conventional speaker, for example, fan, umbrella, or flag etc., so as to further have the market competitiveness.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
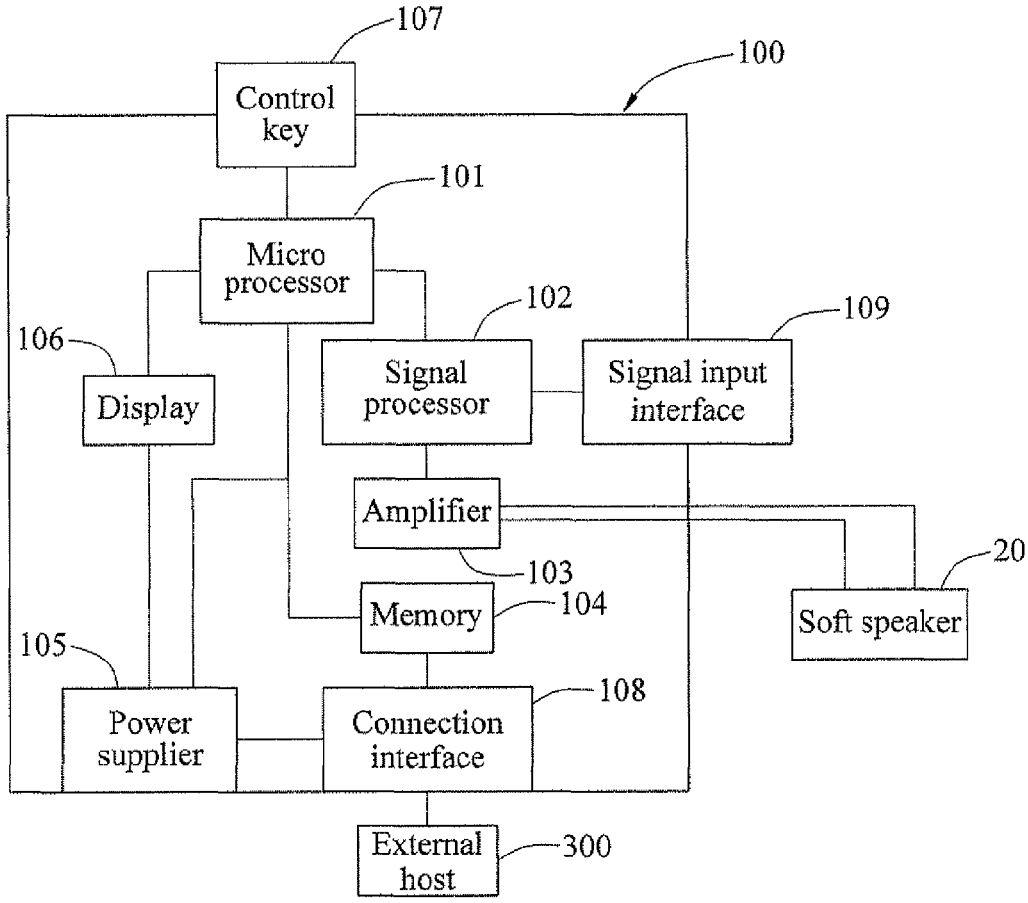
FIG. 1 is a schematic view of a circuit according to an embodiment of the present invention.

FIG. 1 is a schematic view of a circuit according to an embodiment of the present invention. Referring to FIG. 1, an audio player 100 includes a micro processor 101, a signal processor 102, an amplifier 103, a memory 104, a power supplier 105, a control key 107, and a connection interface 108. The audio player 100 is connected to an external host 300 through the connection interface 108. The external host 300 has a power source, a charging circuit, a playing unit, and a memory accessing unit etc., but it is only an exemplary illustration, and is not used to limit the implementation aspect of the present invention.

The micro processor 101 controls an operation of the audio player 100. The memory 104 stores at least one audio data, and is electrically connected to the micro processor 101. The signal processor 102 codes and decodes the audio data, and is electrically connected to the micro processor 101. The amplifier 103 amplifies gains of the audio data and outputs the amplified audio data, and is electrically connected to the signal processor 102. The power supplier 105 supplies an electrical power, and is electrically connected to the micro processor 101 and the memory 104. The power supplier 105 may be a battery (not shown) or may be a rechargeable battery or rechargeable capacitor, and the connection interface 108 is electrically connected to the external host 300, so as to obtain the power source. The control key 107 is used to input manipulation instructions, and is electrically connected to the micro processor 101. The connection interface 108 is electrically connected to the memory 104 and the power supplier 105, so as to externally connect to a data base (not shown) or the external host 300, thereby performing the data access or the charge. The soft speaker 200 is flexible, and is electrically connected to the amplifier 103 for playing the audio data of the memory 104.

In addition, the audio player 100 further includes a signal input interface 109 and a display 106. The display 106 is electrically connected to the micro processor 101 and the power supplier 105, and displays playing information of the display audio player 100. The signal input interface 109 is electrically connected to he signal processor 102, and is externally connected to a microphone (not shown), for inputting an external audio data such as recorded audio.

Figure 2:
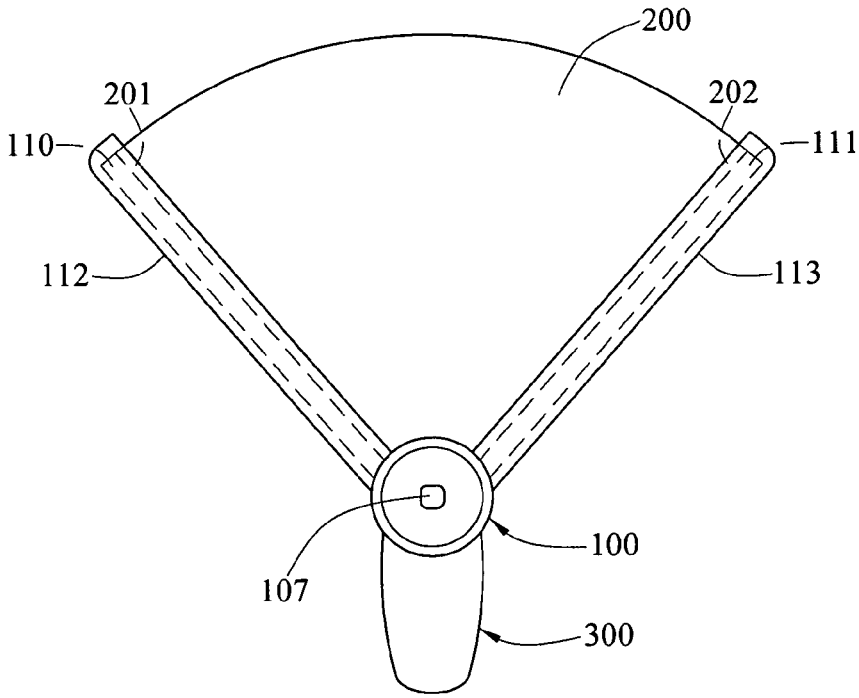
FIG. 2 is a schematic view of an audio playing device according to a first embodiment of the present invention.

The soft speaker 200 may be designed to a fan, flag, or umbrella. The fan shaped soft speaker 200 is taken as an example, and FIG. 2 is a schematic view of the audio playing device according to a first embodiment of the present invention. Referring to FIG. 2, the audio playing device includes an audio player 100, a soft speaker 200, and two suspension edges, and is externally connected to an external host 300 through a connection interface 108 (for example, a universal serial bus (USB) connection port). Here, the external host 300 may be a data base or a compatible electronic device, but it is only the exemplary illustration, and is not used to limit the implementation aspect of the present invention. The audio player 100 includes a micro processor 101, a signal processor 102, an amplifier 103, a memory 104, and a power supplier 105. The audio player 100 not only plays the audio data of the memory 104, but also directly plays the audio data saved in the external host 300.

The amplifier 103 has a positive electrode (not shown) and a negative electrode (not shown). The soft speaker 200 includes a diaphragm (not shown). The two suspension edges are respectively a first suspension edge 110 and a second suspension edge 111. The diaphragm (not shown) has a first electrode 201 and a second electrode 202. In this embodiment, the positive electrode (not shown) of the amplifier 103 is electrically connected to the first suspension edge 110, the negative electrode (not shown) of the amplifier 103 is electrically connected to the second suspension edge 111, the first suspension edge 110 is electrically connected to the first electrode 201 of the diaphragm (not shown), the second suspension edge 111 is electrically connected to the second electrode 202 of the diaphragm (not shown), and the first suspension edge 110 and the second suspension edge 111 are flexible conductors.

The first suspension edge 110 is wrapped by a first insulating frame 112, and the second suspension edge 111 is wrapped by a second insulating frame 113.

Figure 3:
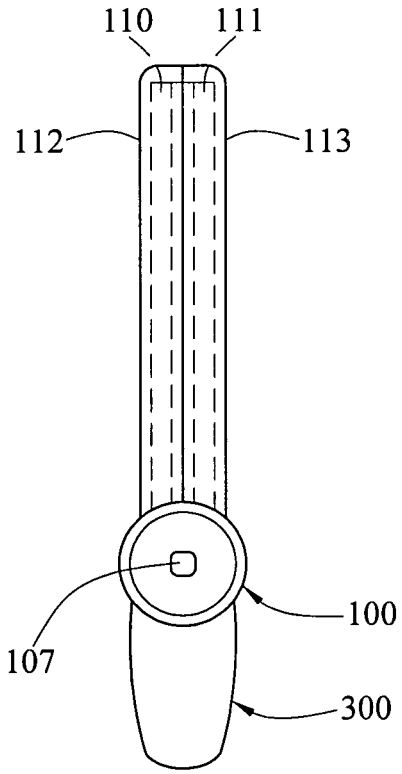
FIG. 3 is a schematic view of an open-close action of the audio playing device according to the first embodiment of the present invention.

As shown in FIG. 3, the first frame 112 and the second frame 113 are pivoted to the audio player 100 for performing an open-close action.

In addition, the soft speaker 200 may be wrapped by a cloth material or a paper material, so as to be accommodated in a space formed in the first frame 112 or the second frame 113. The soft speaker 200 serves as a single sound generating surface, so as to generate a music sound of a single sound channel. Through the structure of this embodiment, this embodiment not only is used for fanning, but also generates the gratifying music.

Figure 4:
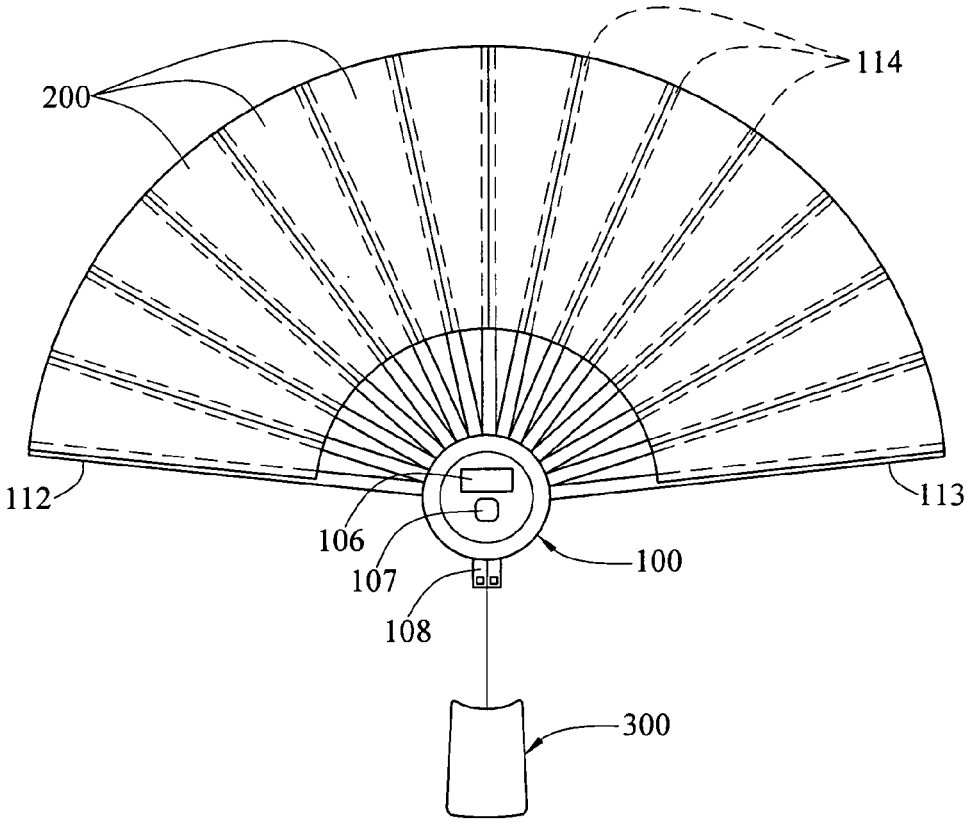
FIG. 4 is a schematic view of the audio playing device according to a second embodiment of the present invention.
Figure 5:
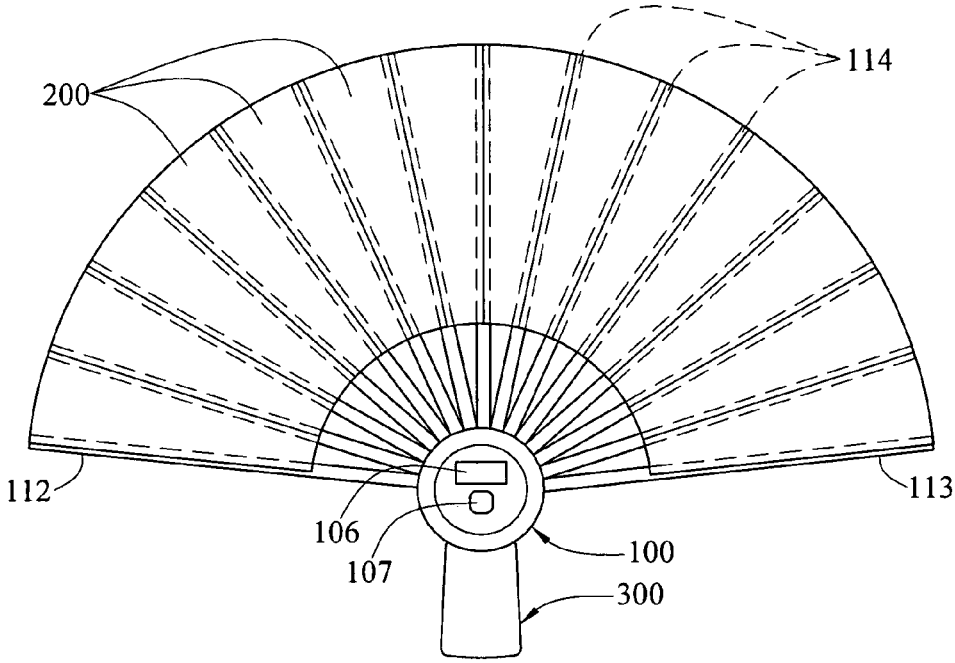
FIG. 5 is a combined view of the audio playing device according to the second embodiment of the present invention.

FIG. 4 is a schematic view of the audio playing device according to a second embodiment of the present invention. Referring to FIG. 4, the audio playing device in a shape of a folding fan includes an audio player 100 and a plurality of soft speakers 200. The audio player 100 also includes a micro processor 101, a signal processor 102, an amplifier 103, a memory 104, and a power supplier 105. As shown in FIG. 5, in this embodiment, the audio playing device is externally connected to an external host 300 through a connection interface 108. Here, the external host 300 may be a data base or a compatible electronic device, but it is only the exemplary illustration.

Figure 6:
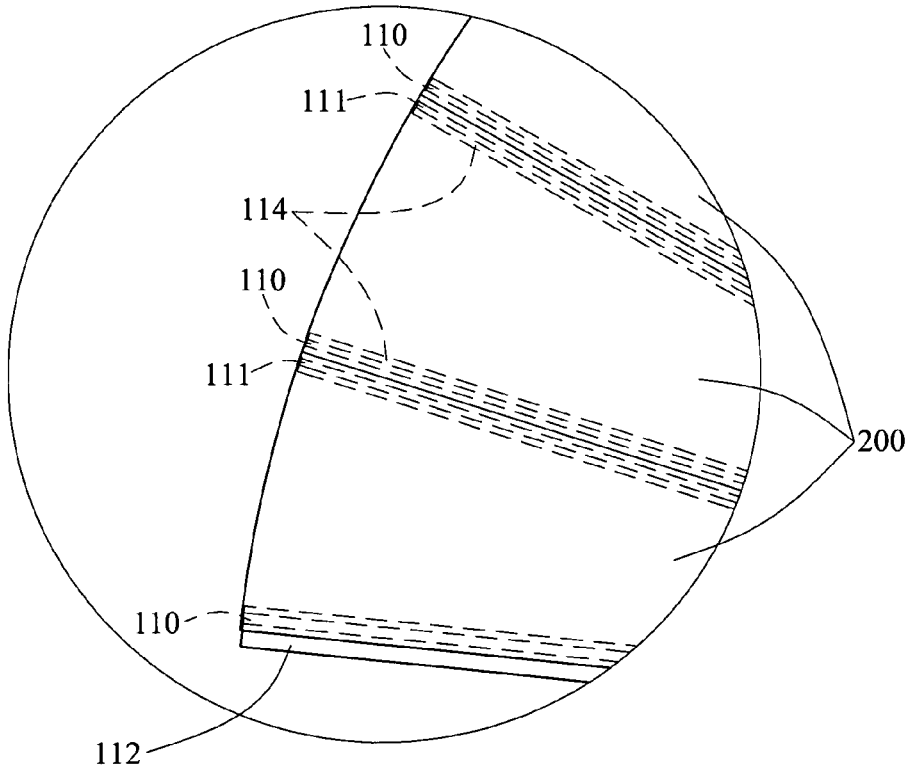
FIG. 6 is a partial enlarged view of the audio playing device according to the second embodiment of the present invention.

This embodiment is approximately the same with the first embodiment, and the first frame 112 and the second frame 113 may perform the open-close action, the main difference is that the appearance design of a plurality of soft speakers 200 is relatively complicated, and a plurality of brackets 114 is added. Each bracket 114 is pivoted the audio player 100, for performing the open-close action of the first embodiment. A partial enlarged view of this embodiment is shown in FIG. 6. The soft speaker 200 is disposed between the brackets 114, and the first electrode 201 and the second electrode 202 of each diaphragm is connected to the amplifier 103, such that in this embodiment, according to the practical demands, the music sound of a plurality of sound channels is generated.

Figure 7:
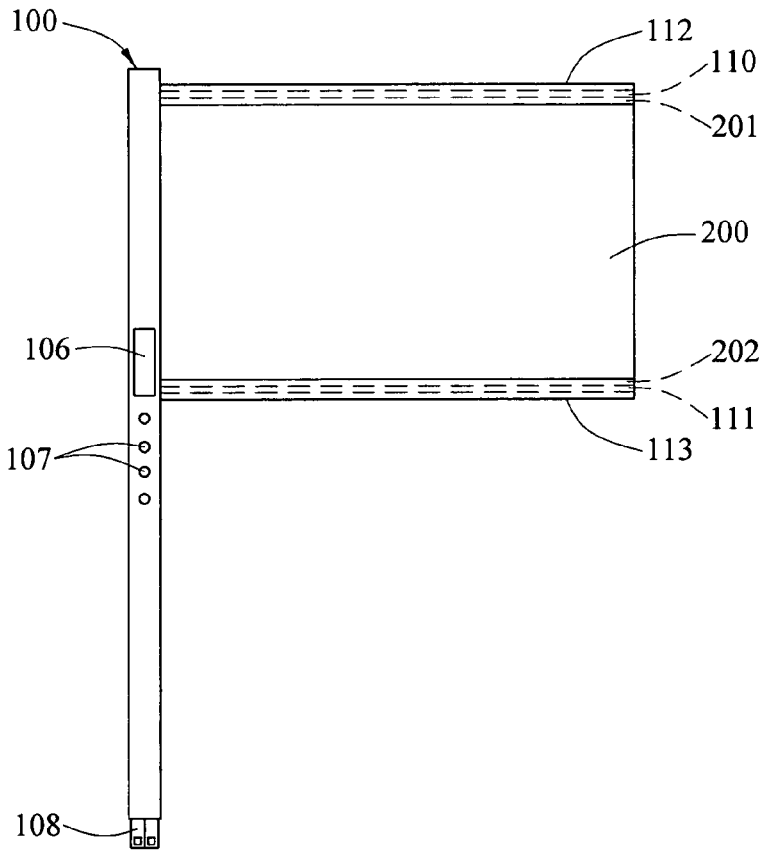
FIG. 7 is a schematic view of the audio playing device according to a third embodiment of the present invention.

FIG. 7 is a schematic view of the audio playing device according to a third embodiment of the present invention. Referring to FIG. 7, the audio playing device in the shape of a flag includes an audio player 100 and a soft speaker 200. The audio player 100 also includes a micro processor 101, a signal processor 102, an amplifier 103, a memory 104, and a power supplier 105. Similarly, the connection interface 108 is connected to a portable external host 300, and then plays the music in the external host 300. A display 106 and a control key 107 are disposed on the audio player 100, such that it is convenient for further operation of the user. Therefore, through the structure of the present invention, this embodiment not only may be used as the flag, but also generates the gratifying music.

Figure 8:
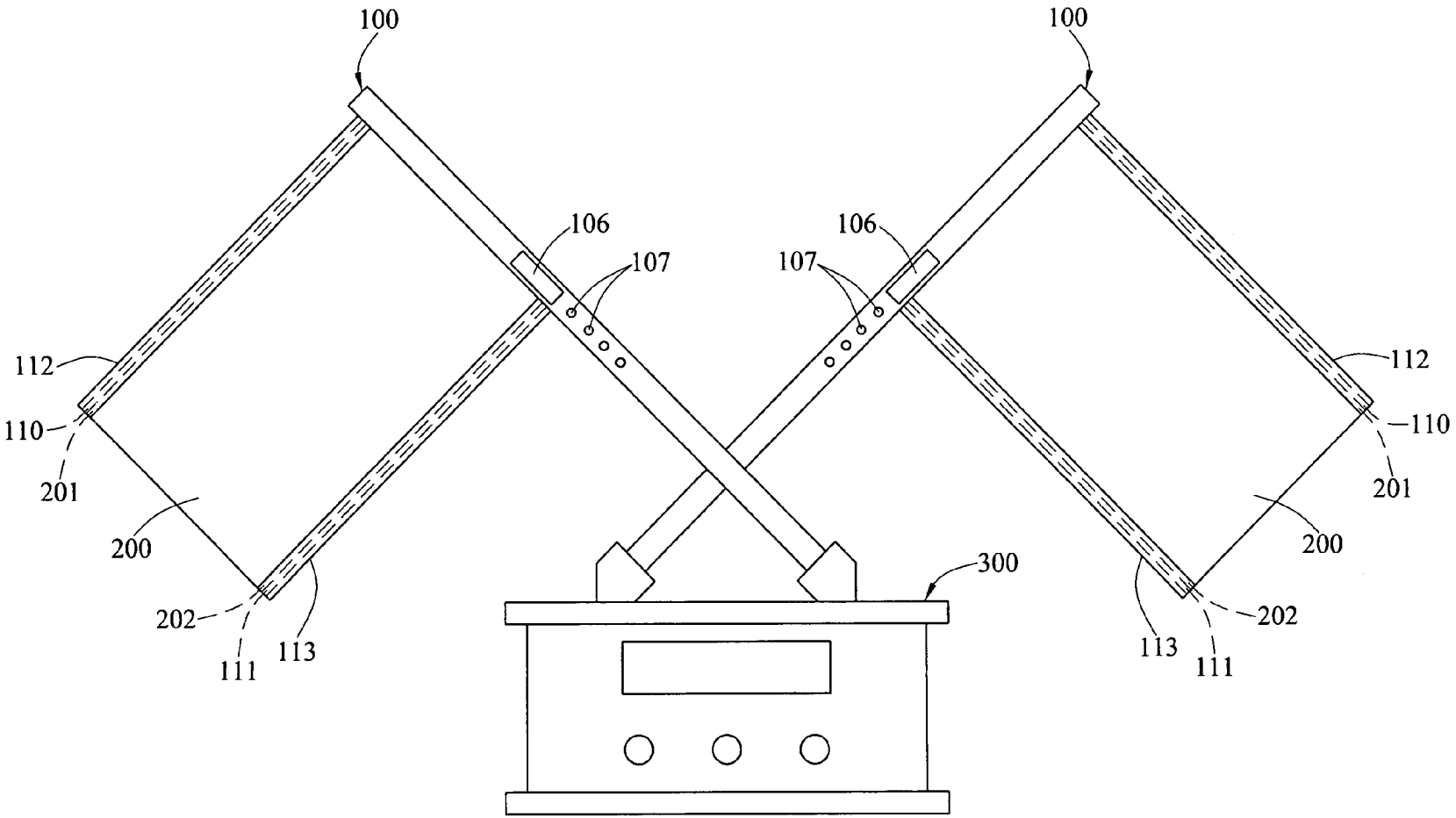
FIG. 8 is a combined view of the audio playing device according to the third embodiment of the present invention.

As shown in FIG. 8, in this embodiment, the audio playing device is externally connected to a desktop external host 300 through the connection interface 108, so as to play the music in the external host 300. Therefore, through the structure of this embodiment, this embodiment not only may be used as a decoration on the desk, but also generates the gratifying music. A display 106 and a control key 107 are disposed on the audio player 100, such that it is convenient for the further operation of the user. Here, the external host 300 may be a data base or a compatible electronic device, but it is only an exemplary illustration.

The main difference with the first embodiment is that the audio player 100 of this embodiment is in the shape of a flagstaff, and has a plurality of control keys 107, but it is only the exemplary illustration, and is not only used to limit the implementation aspect of the present invention. In addition, voice is pre-recorded in the memory 104 through a signal input interface 109, so as to achieve an effect of promotion flag together with the audio playing device in the shape of the flag of this embodiment, and the external host 300 may be connected to a plurality of audio players 100 in the shape of the flag. The above-mentioned is only the exemplary illustration, and is not used to limit the implementation aspect of the present invention.

In addition, the connection relation between the soft speaker 200 and the amplifier 103 of the audio player 100 is the same as that of the first embodiment, but in this embodiment, the first frame 112 and the second frame 113 are formed by the flexible material.

Through the flexible electronic technique, the diaphragm (not shown) of the soft speaker 200 of all the embodiments may select Fluorinated ethylene Propylene copolymer (FEP), Polytetrafluoroethylene (PTFE), or Polyvinylidene fluoride (PVDF), but it is only the exemplary illustration, and is not only used to limit the implementation aspect of the present invention.

The shape structures of all the embodiments may be varied by using the flexible suspension edges and frames.

The audio playing devices of all the embodiments of the present invention may be manipulated through the control key 107 to control the start and close of the audio player 100. When it is started, the audio player 100 obtains the audio data from the memory 104, the signal processor 102 decodes and inputs the audio data to the amplifier 103, the amplifier 103 amplifies the gains of the signal, and then the positive electrode (not shown) and the negative electrode (not shown) of the amplifier 103 transmit the audio data to the soft player 200, so as to generate sound waves.

To sum up, in the present invention, because of the features of the soft speaker such as the light weight and the flexibility, the problems of the common audio player, for example, the weight is relatively heavier, and it is inconvenient for accommodation, are thus solved. In addition, the soft speaker effectively presents the effect of music.

What is claimed is:

1. An audio playing device, comprising:

at least one soft speaker, having a diaphragm, wherein the diaphragm has a first electrode and a second electrode;

at least two suspension edges, respectively being a first suspension edge and a second suspension edge, wherein the first suspension edge is electrically connected to the first electrode of the diaphragm, and the second suspension edge is electrically connected to the second electrode of the diaphragm; and an audio player, electrically connected to the first suspension edge and the second suspension edge, for transmitting an audio data to the soft speaker.

2. The audio playing device according to claim 1, wherein the soft speaker is wrapped by a cloth material or a paper material.

3. The audio playing device according to claim 1, wherein the audio player has a display.

4. The audio playing device according to claim 1, wherein the audio player has a connection interface, for externally connecting to a data base or an external host.

5. The audio playing device according to claim 1, wherein the audio player has a signal input interface, for inputting an external audio data.

6. The audio playing device according to claim 1, wherein the audio player has a power supplier.

7. The audio playing device according to claim 6, wherein the power supplier is a battery, a rechargeable battery, or a rechargeable capacitor.

8. The audio playing device according to claim 7, wherein the audio player is connected to an external host, and the external host has a power source and a charging circuit, and charges the power supplier.

9. The audio playing device according to claim 1, wherein the two suspension edges are flexible conductors.

10. The audio playing device according to claim 9, wherein the two suspension edges are covered by two insulating frames.

11. The audio playing device according to claim 10, wherein the frames are pivoted to the audio player.

* * * * *